US006138987A

United States Patent [19]

Lee

[11] Patent Number: 6,138,987

[45] Date of Patent: Oct. 31, 2000

[54] QUICK-RELEASE CONNECTOR

[76] Inventor: Yen-Chang Lee, No. 98-1, Chiu-Sheh Lane, Pei-Twen Dist., Taichung, Taiwan

[21] Appl. No.: 09/356,305

[22] Filed: Jul. 16, 1999

[51] Int. Cl.[7] ..... F25B 45/00

[52] U.S. Cl. ..... 251/152; 251/315.14; 62/292

[58] Field of Search ..... 251/148, 151, 251/152, 315.01, 315.1, 315.13, 315.14; 62/77, 292

[56] References Cited

U.S. PATENT DOCUMENTS

| | | | |
|---|---|---|---|
| Re. 34,715 | 9/1994 | Gudenau et al. | 251/149.6 |
| 3,628,768 | 12/1971 | Hutt | 251/148 |
| 4,006,881 | 2/1977 | Gaillard | 251/148 |
| 4,590,628 | 5/1986 | DeGregorio | 251/315.1 |
| 5,056,560 | 10/1991 | DeMartelaere | 251/149.5 |
| 5,915,402 | 6/1999 | Mitchell, II | 251/148 |

*Primary Examiner*—Joseph A. Kaufman
*Assistant Examiner*—Eric Keasel
*Attorney, Agent, or Firm*—Dellett and Walters

[57] ABSTRACT

An improved quick-release connector for replenishing air conditioning coolant has a female connector and a male connector detachably connecting with the female connector, wherein the male connector comprises a hollow body, a ball valve with a radial passage defined therein operatively received in the hollow body, a cap screwed on one end of the hollow body with an inlet fitting screwed therein, an inlet channel defined in the cap communicating with the inlet fitting and the interior of the hollow body and a control button provided on the ball valve for controlling of the communication and flow of the coolant. Two caulking blocks with concave surfaces are provided on opposite sides of the ball valve respectively to improve water tightness and reduce the abrasion to increase life of the connector.

9 Claims, 9 Drawing Sheets

QUICK-RELEASE CONNECTOR

BACKGROUND OF THE INVENTION

1. Field of the Invention

The present invention relates to an improved quick-release connector for replenishing coolant in an air conditioner. The quick-release connector comprises a female connector and a male connector detachably connected with the female connector, wherein the male connector has a ball valve provided therein.

2. Description of Related Art

Air conditioning coolant needs to be replenished from time to time. A quick-release connector is used to inject coolant into an air conditioning system. Referring to FIGS. 7, 8 and 9, a conventional quick-release connector has a female connector (90) and a male connector (not numbered) detachably connected with the female connector (90). The male connector comprises a hollow body (60), a driving rod (70) movably received in the hollow body (60) and a closing tube (80) abutting the driving rod (70) within the hollow body (60).

The hollow body (60) has a neck (61) integrally formed on one end and provided with multiple balls (66) around the periphery thereof, a quick-release collar (67) movably mounted around the neck (61), a first spring (68) placed between the quick-release collar (67) and the hollow body (60) and a retaining ring (69) secured in the neck (61). The free end of the hollow body (60) is threaded into a cap (78). A first and a second groove (611, 63) are defined in the hollow body (60) to respectively receive a first and a second O-ring (62, 64).

The driving rod (70) has a push end (72) and a shoulder (73) formed near the push end (72). A sealing ring (74) is provided between the shoulder (73) and an inner incline (82) in the closing tube (80).

A second spring (86) is provided between the closing tube (80) and an inner step in the hollow body (60) to force the closing tube (80) to press against the sealing ring (74).

An inlet (88) is screwed into the sidewall of the hollow body (60) to communicate with the inner channel in the hollow body (60).

As seen in FIG. 9, when the male connector is connected to the female connector (90), the driving rod (70) is pushed by the second spring (86) to engage with a closing pin (92) in the female connector (90) and, the closing tube (80) is pushed by the female connector (90). Afterwards, the inner incline (82) is separated from the sealing ring (74). Meanwhile, the closing pin (92) is pushed by the push end (72) of the driving rod (70) to communicate the female connector (90) with the male connector. Then, the coolant is able to flow from the inlet (88) into the hollow body (60) and the female connector (90).

However, a defect exists in the above disclosed connector. The first and the second O rings (62, 64) are respectively rubbed by the closing rube (80) and the female connector (90), thereby the first and the second O rings (62, 64) are worn out after repeated connection between the female and the male connectors, and the tight seal of the connector is decreased and the life span of the connector is reduced.

Therefore, it is an objective of the invention to provide an improved quick-release connector to mitigate and/or obviate the aforementioned problems.

SUMMARY OF THE INVENTION

The main object of the present invention is to provide an improved quick-release connector having a female connector and a male connector detachably connected to the female connector, wherein the male connector comprises a hollow body, a ball valve with a radial passage defined therein and operatively received in the hollow body, a cap screwed on one end of the hollow body and having an inlet screwed thereon, an inlet channel defined in the cap for communicating with the inlet and the hollow body, and a control button provided on the top end of a post formed on the ball valve for controlling the communication between the inlet and an outlet defined in the hollow body and adjusting the flow of coolant therebetween. Two caulking blocks each defined with a central hole therein are provided at opposite sides of the ball valve, each caulking block is concave to abut the ball valve, therefore watertightness of the connector is improved, and abrasion of the sealing rings is reduced to increase the life of the connector.

Other objects, advantages and novel features of the invention will become more apparent from the following detailed description when taken in conjunction with the accompanying drawings.

DETAILED DESCRIPTION OF THE PREFERRED EMBODIMENT

A quick-release connector has a female connector and a male connector detachably connected to the female connector, wherein the focus of the invention lies in the structure of the male connector, such that detailed description to the structure of the female connector is omitted.

Figure 1:
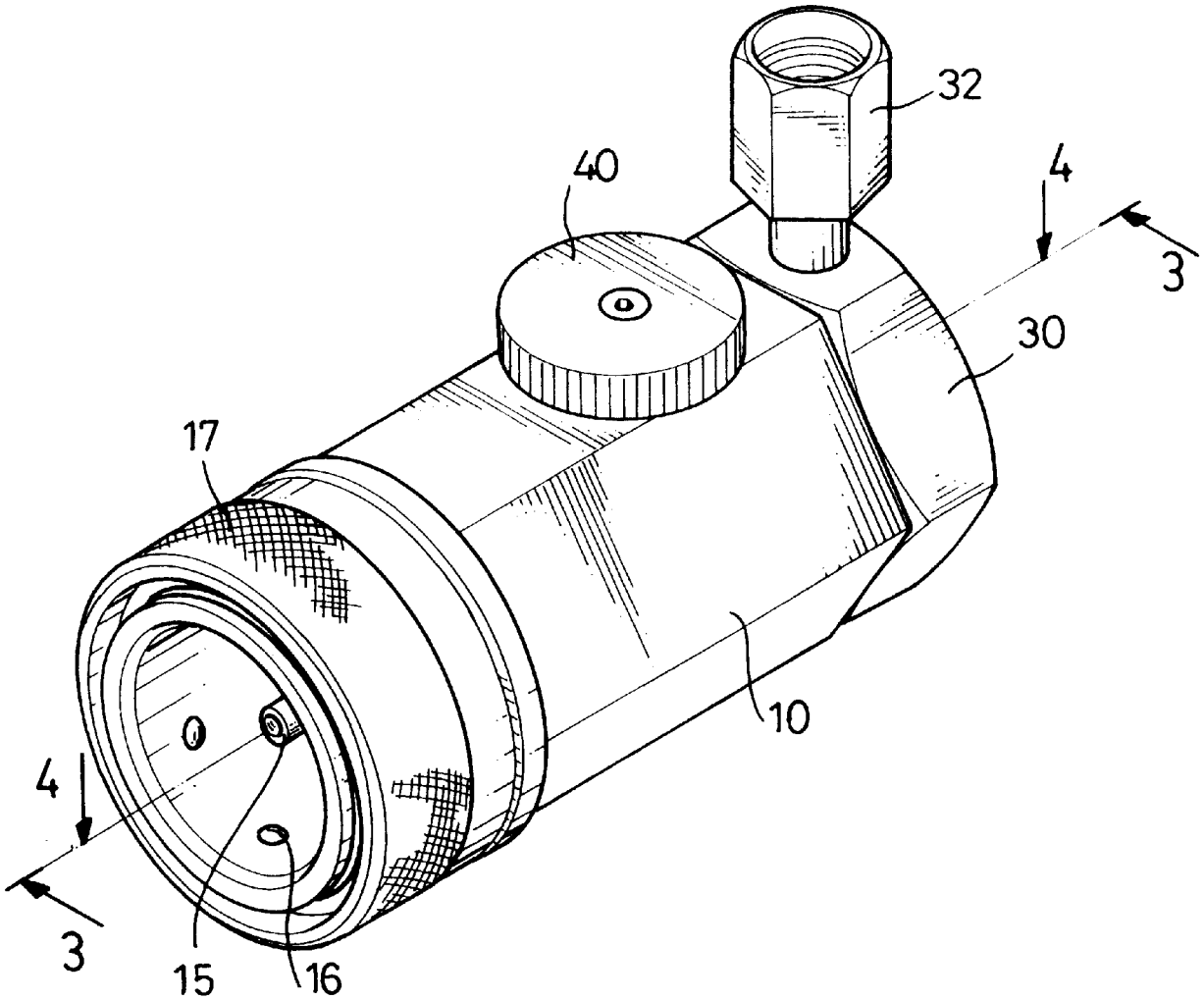
FIG. 1 is a perspective view of a connector in accordance with the present invention.
Figure 2:
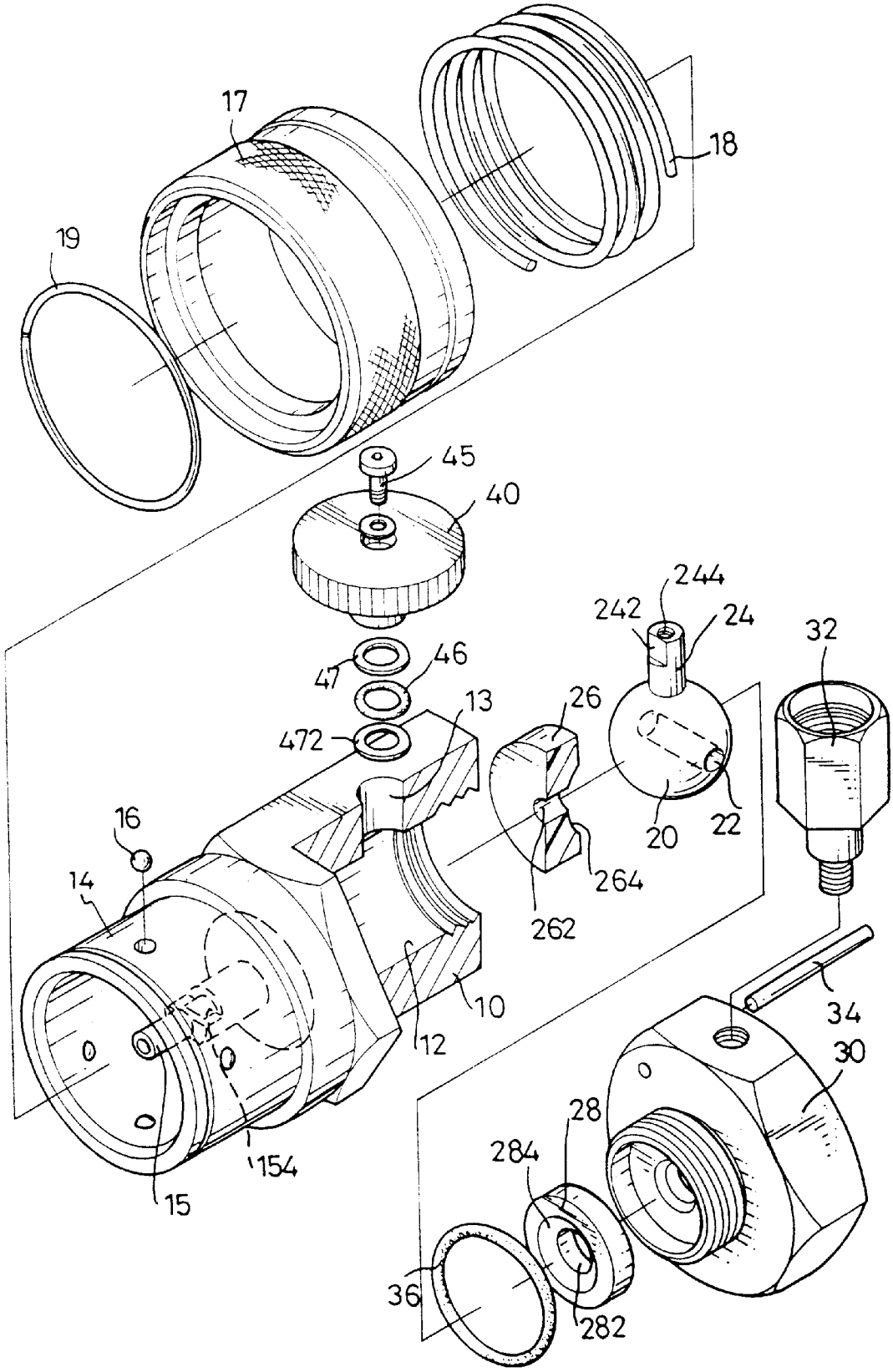
FIG. 2 is an exploded perspective view of the connector in FIG. 1.
Figure 3:
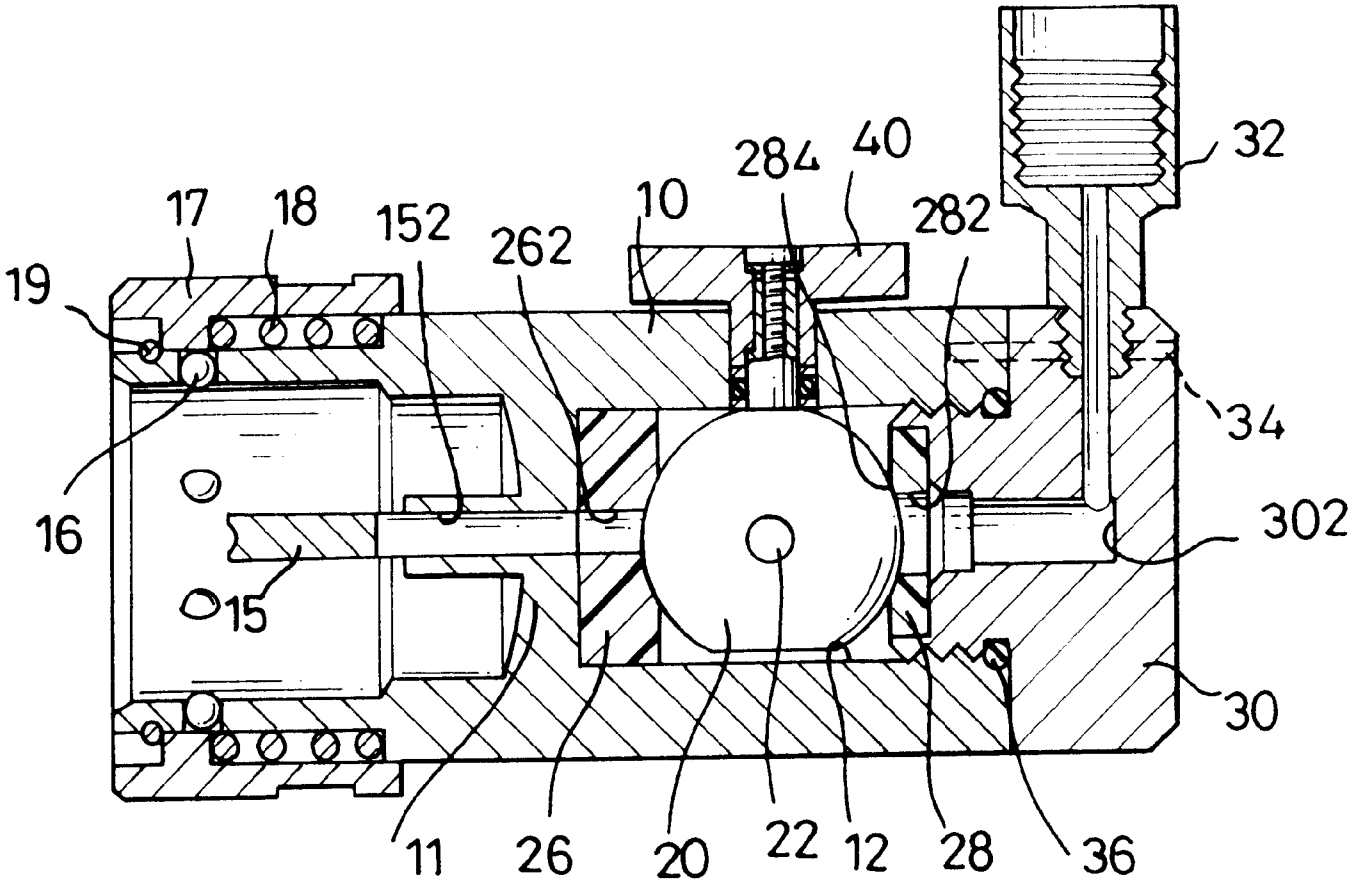
FIG. 3 is a cross sectional side view of the connector in FIG. 1 along line 3—3.

As shown in FIGS. 1, 2 and 3, the male connector in accordance with the present invention comprises a hollow body (10), a ball valve (20) operatively received in the hollow body (10) and having a radial passage (22) defined therein, a cap (30) screwed on one end of the hollow body (10) with an inlet fitting (32) screwed therein, an inlet channel (302) defined to communicate with the inlet fitting (32) and the hollow body (10), and a control button (40) provided on the top end of a post (24) formed on the ball valve (20).

Figure 4:
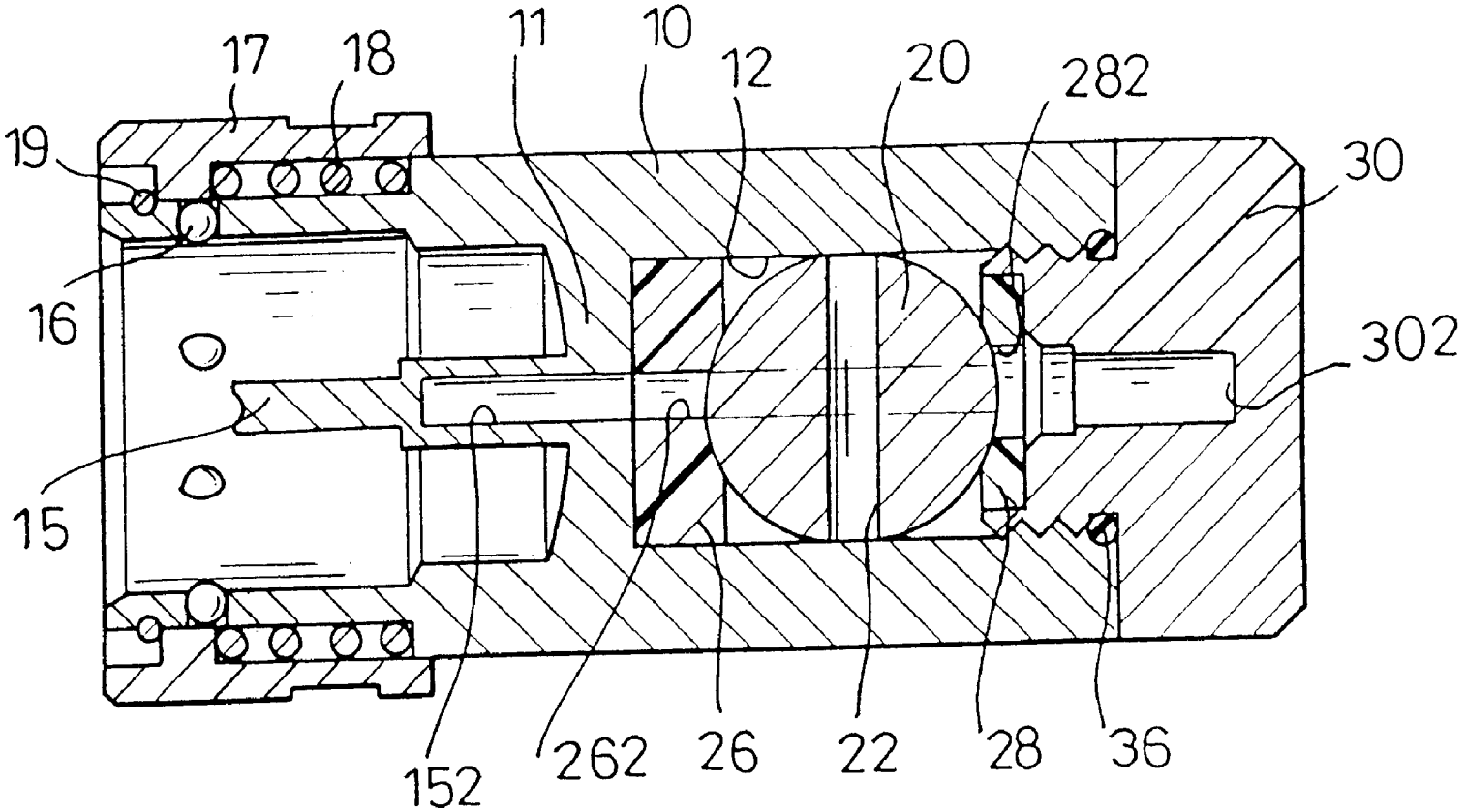
FIG. 4 is a cross sectional top view of the connector in FIG. 1 along line 4—4.
Figure 5:
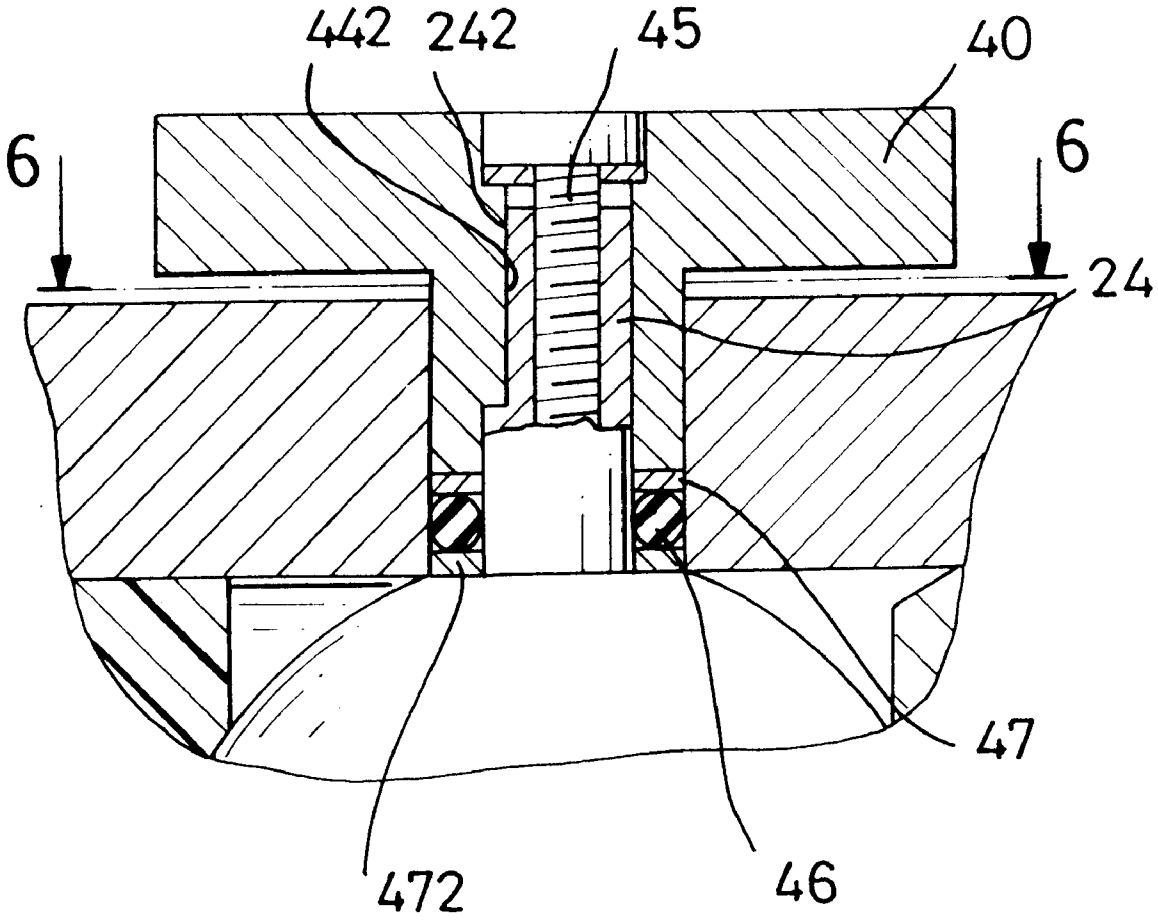
FIG. 5 is an enlarged cross sectional side view of the control button of the connector in FIG. 3.
Figure 6:
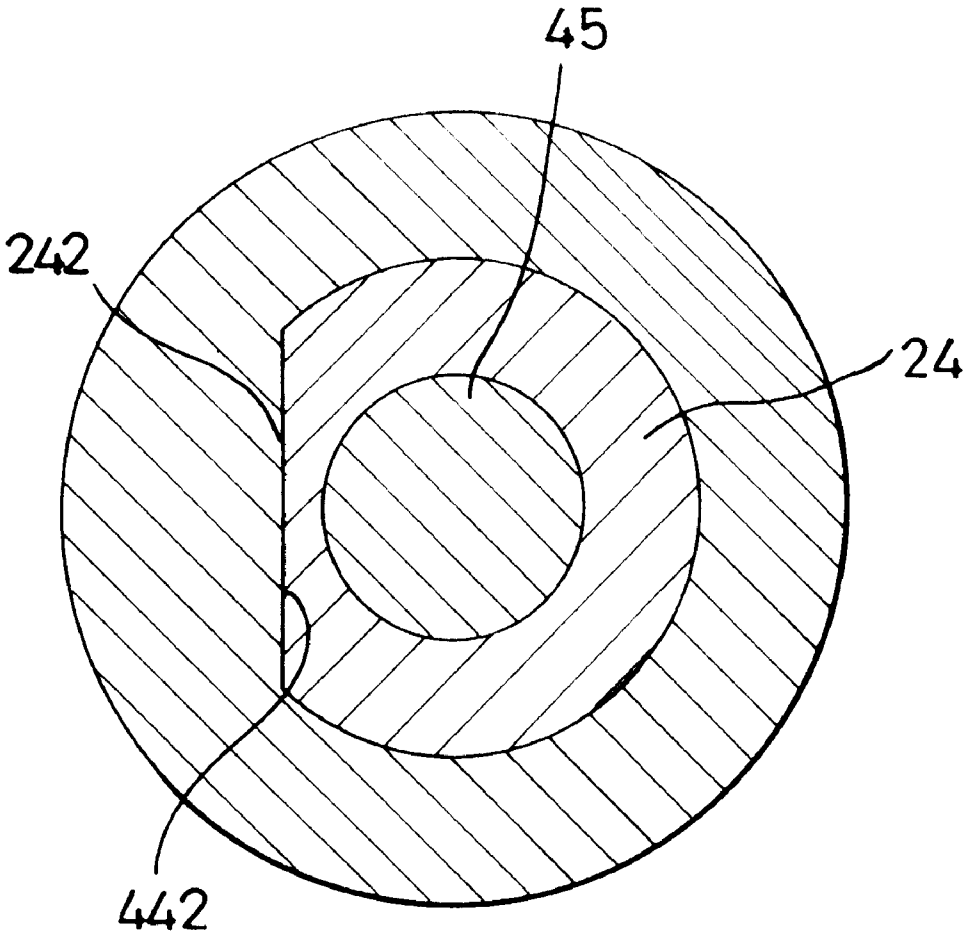
FIG. 6 is a cross sectional top view of the control button of the connector in FIG. 5 along line 6—6.
Figure 7:
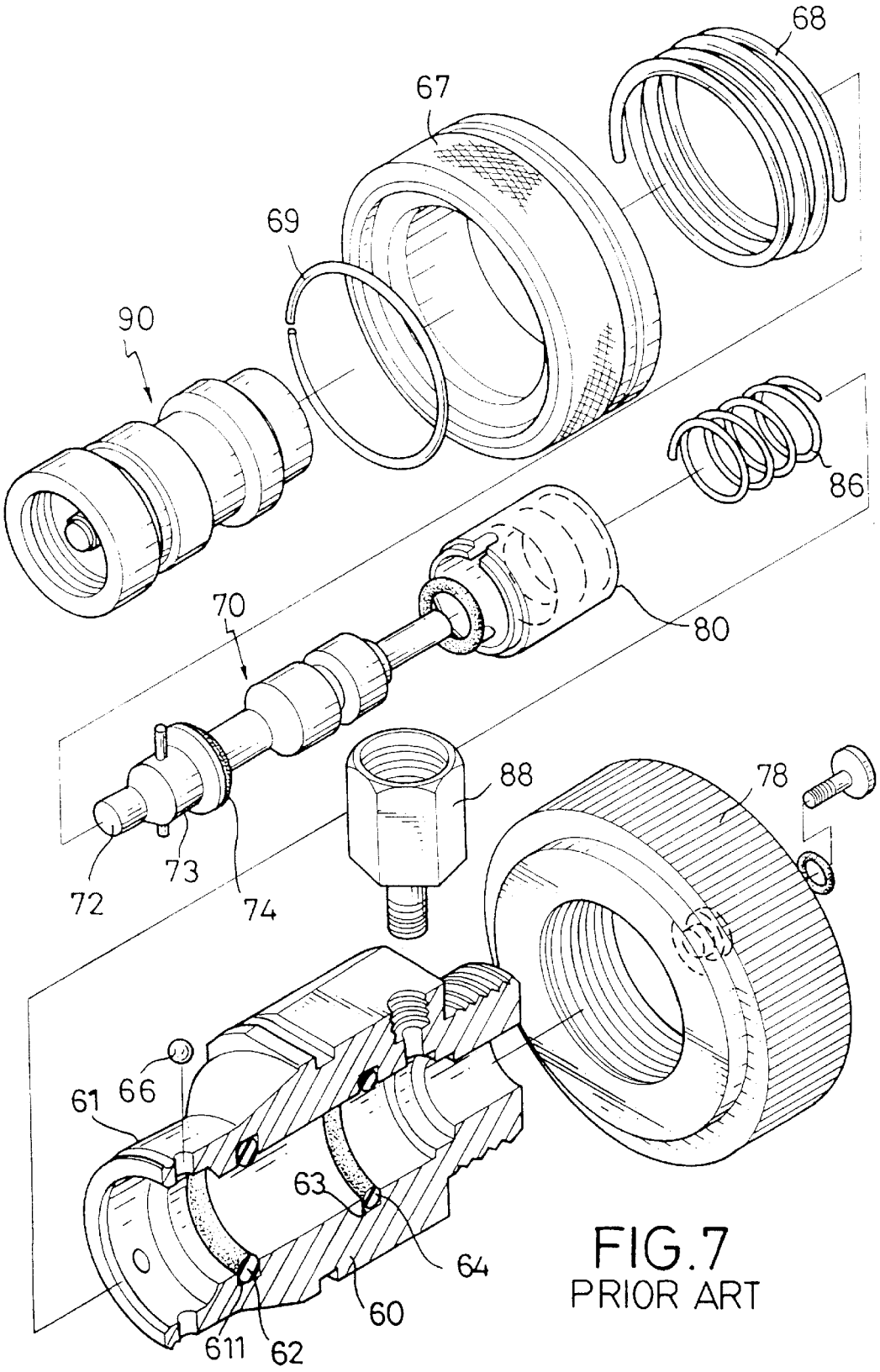
FIG.7 PRIOR ART
FIG. 7 is an exploded perspective view of a conventional connector.
Figure 8:
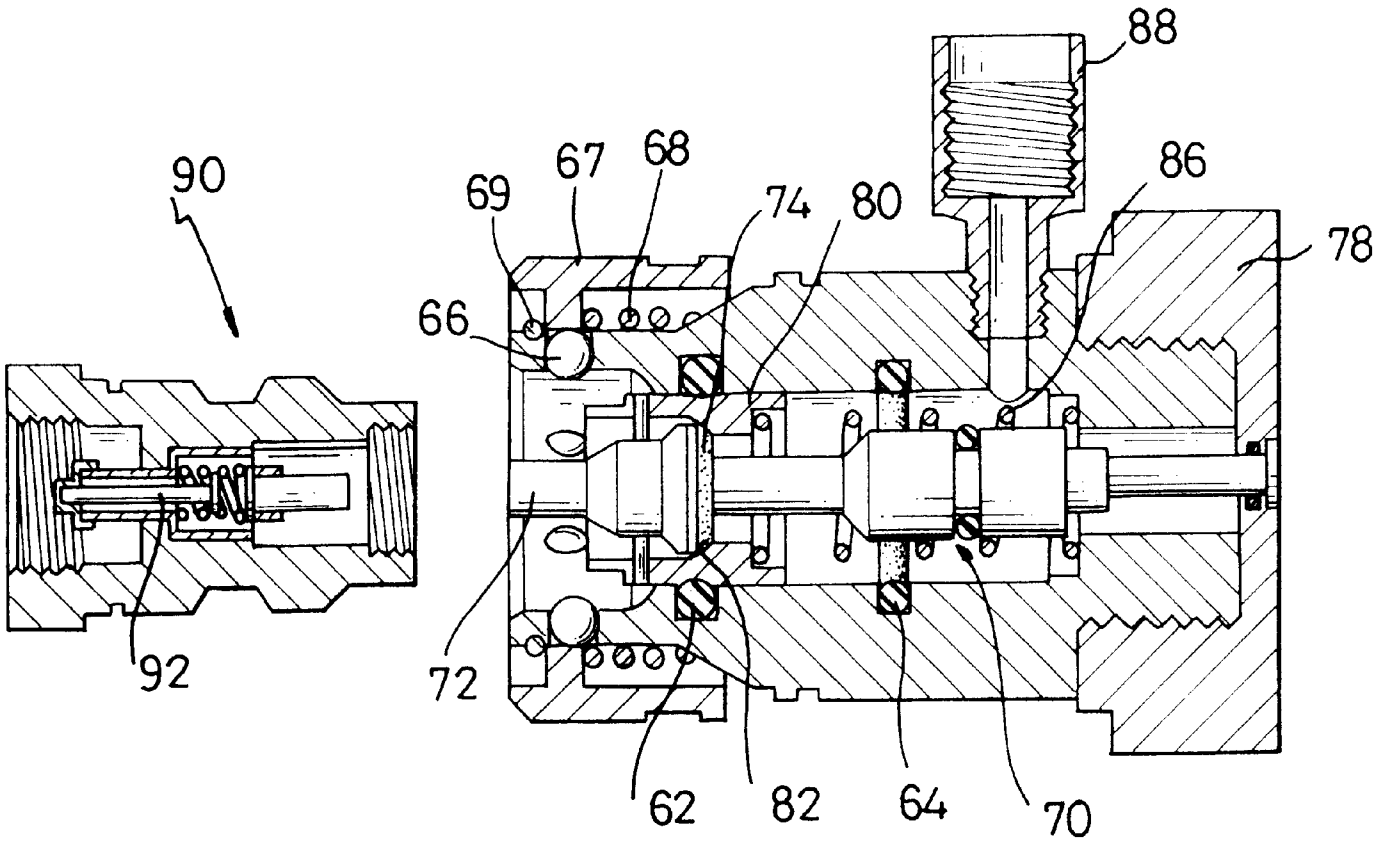
FIG. 8 PRIOR ART
FIG. 8 is a cross sectional side view of the conventional connector in FIG. 7.
Figure 9:
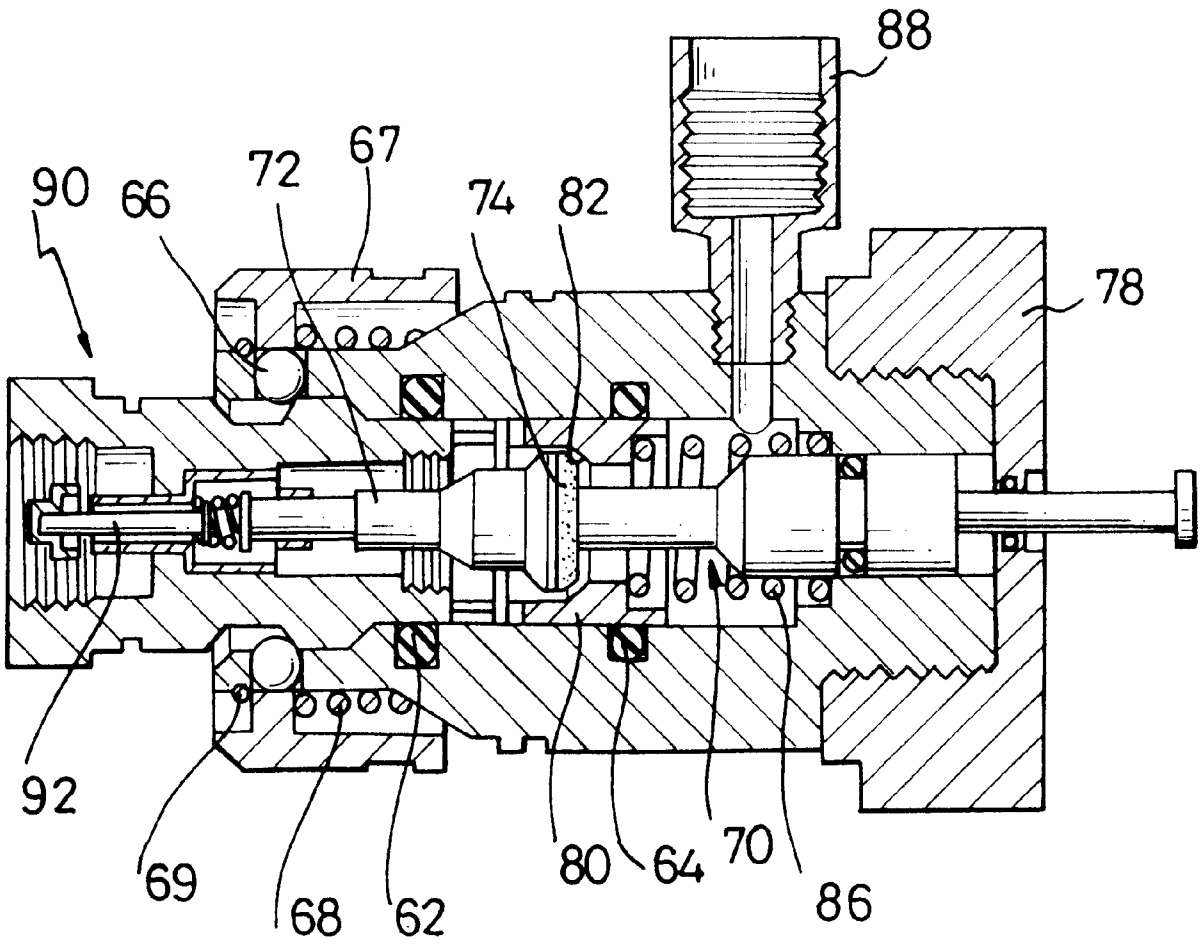
FIG. 9 PRIOR ART
FIG. 9 is a cross sectional side view of the conventional connector, showing it connected.

The hollow body (10) forms a radial inner partition (11) (as shown in FIG. 3 and 4) in the middle thereof, and defines a chamber (12) in the end to receive the ball valve (20). A through hole (13) is defined in the sidewall of the hollow body (10) to allow the post (24) of the ball valve (20) to extend out after the ball valve (20) is received in the chamber (12). A protrusion (15) extends from the partition (11) in the opposite direction from the chamber (12). A channel (152) is defined in the protrusion (15) to selectively align with the passage (22), and an outlet (154) of the channel (152) is defined in the sidewall of the protrusion (15).

The hollow body (10) further has a neck (14) on the end opposite from the cap (30), equally separated balls (16) in the neck (14), a moving sleeve (17) around the neck (14), a spring (18) between the sleeve (17) and the hollow body (10) and a retaining ring (19) secured in the neck (14), whereby the neck (14) of the male connector is able to be quickly connected with and released from the female connector.

The post (24) of the ball valve (20) forms a flat locking surface (242), which is mated in a corresponding flat section of the central bore (442) defined in the control button (40) and a screw (45) secures the control button (40) to the post (24). A first sealing ring (46) is provided around the post (24) between the control button (40) and the ball valve (20), and has two washers (47, 472) provided at opposite sides thereof to form a watertight seal and to increase life of the first sealing ring (46).

The ball valve (20) has a caulking block (26, 28) on each side are respectively defined a central hole (262, 282) is defined in the caulking blocks (26, 28) to align with the inlet channel (302) and the outlet channel (152). Moreover, the caulking blocks (26, 28) respectively have a concave surface (264, 284) conforming to the curvature of the ball valve (20) towards the ball valve (20) according to tightly abut on the ball valve (20). A preferred embodiment of the male connector has the cap (30) abutting and securing one of the two caulking blocks (28).

An O-ring (36) is provided between the cap (30) and the hollow body (10). A pin (34) is inserted through the cap (30) into the hollow body (10) to secure the cap (30) with the body (10).

When the male connector is connected with the female connector, the protrusion (15) pushes closing pin (92) provided in the female connector (90). Coolant flows from the inlet fitting (32) into the inlet channel (302) of the cap (30), when the passage (22) of ball valve (20) is crosswise to the inlet channel (302), coolant flow is blocked by the ball valve (20); and when the passage (22) is aligned with the inlet channel (302) and the outlet channel (152), coolant is able to flow from the male connector into the female connector (90).

The present invention has following advantages:

1. The structure of the male connector is simple and easy to be fabricated;
2. The flow of coolant is controllable by the control button; and
3. The water tightness of the male connector is increased.

What is claimed is:

1. A quick-release connector has a female connector and a male connector detachably connected to the female connector, wherein the improvements comprising:

the male connector has a hollow body (10), a ball valve (20) with a radial passage (22) defined therein operatively received in the hollow body (10), a cap (30) screwed on one end of the hollow body (10) with an inlet fitting (32) screwed thereon, an inlet channel (302) defined in the cap (30) to communicate with the inlet fitting (32) and the interior of the hollow body (10) and a control button (40) provided on a top of a post (24) formed on the ball valve (20);

wherein the hollow body (10) includes a radial inner partition (11) formed in the middle of the hollow body (10);

a chamber (12) defined in the end covered by the cap (30) to receive the ball valve (20) therein;

a through hole (13) defined in the sidewall thereof to receive the post (24) of the ball valve (20);

a protrusion (15) formed on the partition (11) extending from the partition (11) in the direction opposite from the chamber (12); and an outlet channel (152) defined in the protrusion (15) to align with the passage (22) having an outlet (154) defined in the sidewall of the protrusion (15).

2. The quick-release connector as claimed in claim 1, wherein the post (24) of the ball valve (20) forms a flat locking surface (242), which is mated in a corresponding flat section of the central bore (442) defined in the control button (40) and secured with the control button (40) by a screw (45).

3. The quick-release connector as claimed in claim 2, wherein a first sealing ring (46) is provided around the post (24) of the ball valve (20) between the control button (40) and the ball valve (20).

4. The quick-release connector as claimed in claim 3, wherein the first sealing ring (46) has two washers (47, 472) provided on opposite sides thereof.

5. The quick-release connector as claimed in claim 1, wherein the ball valve (20) has caulking blocks (26, 28) provided on opposite sides thereof, the caulking blocks (26, 28) respectively define a central hole (262, 282) therein to align with the inlet channel (302) and the outlet channel (152).

6. The quick-release connector as claimed in claim 5, wherein the caulking blocks (26, 28) respectively have a concave side surface (264, 284) towards the ball valve (20) conforming to the curvature of the ball valve (20).

7. The quick-release connector as claimed in claim 5, wherein one of the caulking blocks (28) is secured with the cap (30).

8. The quick-release connector as claimed in claim 1, wherein an O-ring ring (36) is provided between the cap (30) and the hollow body (10).

9. The quick-release connector as claimed in claim 1, wherein a pin (34) is inserted through the cap (30) and into the hollow body (10).

* * * * *